US005420580A

United States Patent [19]

Rawls

[11] Patent Number: 5,420,580

[45] Date of Patent: May 30, 1995

[54] ROADWAY HAZARD WARNING SYSTEM AND METHOD

[75] Inventor: Thomas F. Rawls, Plantation, Fla.

[73] Assignee: University of South Florida, Tampa, Fla.

[21] Appl. No.: 999,528

[22] Filed: Dec. 29, 1992

[51] Int. Cl.[6] ..... G08G 1/01

[52] U.S. Cl. ..... 340/936; 340/905

[58] Field of Search ..... 340/933, 937, 941, 940, 340/942, 943, 905, 936; 364/438; 180/167, 171

[56] References Cited

U.S. PATENT DOCUMENTS

| | | | |
|---|---|---|---|
| 2,493,755 | 1/1950 | Ferrill, Jr. | 340/905 |
| 2,640,979 | 6/1953 | Carter | 340/936 |
| 2,911,635 | 11/1959 | Ross | 340/905 |
| 3,024,414 | 3/1962 | Nordqvist | 340/936 |
| 3,085,646 | 4/1963 | Paufve | 340/941 |
| 3,544,958 | 12/1970 | Carey et al. | 340/936 |
| 3,609,678 | 9/1971 | Fayling . | |
| 3,668,624 | 6/1972 | Spaulding | 340/905 |
| 3,775,743 | 11/1973 | Carter | 340/905 |
| 4,173,010 | 10/1979 | Hoffmann . | |
| 4,401,181 | 8/1983 | Schwarz | 364/447 |

*Primary Examiner*—Brent Swarthout

*Attorney, Agent, or Firm*—Allen, Dyer, Doppelt, Franjola & Milbrath

[57] ABSTRACT

A motor vehicle warning system for use on a roadway having an established safe speed comprises a sensing and processing circuit located on the motor vehicle. Signaling elements are strategically placed on the roadway in advance of a hazardous area for the vehicle. The signaling elements, such as permanent magnets, are separated by a distance indicative of a recommended safe speed for executing the hazard. An induction coil located on the underside of the vehicle senses the magnetic field from the magnets as the vehicle passes and provides an input to the sensing and processing circuit. The time period for the vehicle to traverse the distance between the elements is compared in a logic circuit to the recommended time period representative of a safe speed. If the vehicle speed exceeds the safe speed, a warning signal is generated to give the driver additional time to react to the potentially dangerous situation that is about to be encountered. Adjustments to the indicated safe speed may be made to account for other conditions, such as an elderly driver or windshield wiper or headlight operation, for example.

16 Claims, 2 Drawing Sheets

ROADWAY HAZARD WARNING SYSTEM AND METHOD

BACKGROUND OF THE INVENTION

1. Field of the Invention

The invention relates generally to motor vehicle safety systems and methods, and specifically to warning systems and methods having means onboard the motor vehicle for developing warning signals from magnets or similar devices affixed on a roadway over which the vehicle is passing so as to warn a driver of the vehicle of an oncoming hazardous driving condition.

2. Background Art

On a national basis, most fatal motor vehicle accidents occur during nighttime driving. A major contributing factor to these motor vehicle accidents is driver inattentiveness and in particular the driver's inappropriate actions. The driver needs a warning that the present or approaching condition warrants more attention. The warning must be sufficient to encourage the driver to pay more attention to the driving task.

A number of systems have been proposed for the control of motor vehicles along a roadway through the use of sensors on the vehicle which cooperate with signal devices on the roadway for determining the position of the vehicle. The signal devices on the roadway have taken the form of electrical wires or magnetic material embedded in the roadway surface at predetermined positions along the roadway. The sensors are positioned on the vehicle to detect the proximity to the signal area of the roadway using as an example, magnetic pickup devices. The proximity of the vehicle is then determined and electronic systems used to provide control commands to the vehicle. The complexity and cost of such systems has been blamed for their lack of use.

U.S. Pat. No. 3,609,678 to Fayling discloses a magnetized means for providing control information to vehicles traveling on the roadways. The magnets disclosed are polymer-based magnets which comprise a tough organic polymeric matrix and particles of magnetic material uniformly distributed through the matrix. The magnets are installed in the form of a sheet or tape in a channel formed in the roadway surface and are arranged in geometries or are magnetized in patterns to develop information-providing signals in magnetic flux sensors in vehicles traveling over the magnets.

U.S. Pat. No. 4,401,181 to Schwarz discloses a road vehicle control system for use with a roadway having magnetic marking elements. The magnetic elements define the lanes of travel and zones of lower speed on the roadway. A plurality of sensors mounted on the motor vehicle detect proximity to the marking elements and a connected control means produces control signals corresponding to the position of the vehicle with respect to the lane of travel and also of the presence of a lowered speed zone. Circuitry is disclosed for developing speed command signals for operating a steering servo and speed control commands to a speed servo. In one embodiment an array of four sensors is positioned along the width of the motor vehicle and a variable connecting means is provided so that the left and right sensors can develop the steering signals for a roadway having lane-edge markers, or the center two sensors can provide steering signals for use on a roadway having lane center marking elements.

In another speed control device, U.S. Pat. No. 4,173,010 to Hoffmann discloses a traffic sign and system for recording vehicle speed which uses positioning sensors adjacent a roadway. The sensors comprise pressure switches connected to two speed hoses to be run over, as in a traffic counter. Photo-optical, acoustical or magnetic sensors are also suggested. The sensors are spaced a predetermined distance apart in the direction of travel, and provide information to a logic system to measure the speed of vehicles traveling along the roadway. The logic system is connected to a simple readout sign displayed for observation by drivers of vehicles along the roadway, which sign indicates whether a vehicle is traveling at a proper rate, or too fast, or too slow, or too close to a preceding vehicle. The patent also discloses a modified motion picture camera provided adjacent the roadway to film a vehicle that is moving too rapidly, and a modified film editing device is provided for counting the frames exposed and thereby determining the speed of the vehicle.

U.S. Pat. No. 4,833,469 to David discloses an obstacle proximity detector for use in automobiles that provides a warning signal to both the car and the driver that the automobile is approaching an obstacle at an unsafe speed or is getting too close to the obstacle. The system detects the differential velocity between the car and the obstacle and determines the distance separating the car from the obstacle which may be fixed or moving in a general direction oriented in the same direction as that followed by the system equipped vehicle. A signal is generated whenever the combination of differential velocity and separation distance reaches an unsafe level. This signal is then processed so as to emit various types of signals that can be seen, heard and/or be used for taking emergency action such as causing the vehicle brakes to be applied automatically if the driver does not heed the passive signals already emitted.

SUMMARY OF INVENTION

The present invention finds itself within the art described above and focuses on providing a system having its electronic circuitry onboard the motor vehicle, relying on permanent magnets strategically placed on the roadway at a hazardous roadway condition, such as a curve.

The present invention contemplates motor vehicle warning systems and methods for alerting a driver of the motor vehicle to an upcoming roadway hazard, to promote cautious driving in advance of placing the driver in a potentially dangerous situation. In other words, the system increases the time that the driver has to react to a hazardous condition. As an example, if a driver were to brake before entering a curve, the curve can be traversed safely. If the driver does not anticipate the extent of the hazard being approached and brakes within the curve, the vehicle may go into a skid and then out of control.

The motor vehicle warning system for use on a roadway having an established safe speed comprises means for indicating the safe speed, means for determining the present vehicle speed, and means for comparing these speeds. A warning signal is generated within the vehicle if the vehicle speed exceeds the indicated safe speed. The means for indicating the safe speed comprises a first and a second marking element placed upon the roadway in advance of an upcoming hazard. The separation of the first element to the second element is based on the safe speed established for a given upcoming condition and a predetermined constant time period for use as a standard in separating the elements. The second marking element is affixed to the roadway separated from the first marking element by a distance determined by the product of the safe speed and the constant time period.

In the preferred embodiment of the invention, the marking elements are permanent magnets. A sensor onboard the vehicle detects the magnetic field as the vehicle passes proximate to the elements. A first sensing signal is generated when the vehicle passes proximate to the first marking element and a second sensing signal is generated when the vehicle passes proximate to the second marking elements. A timing circuit receiving the first sensing signal initiates a start of a constant period pulse coincident with a first pulse from the first sensing signal initiated by the first marking element. A logic circuit compares the constant period pulse length to a vehicle time period length determined to be the time between the first pulse and a second pulse initiated as the vehicle passes proximate to the second marking element. If the vehicle time period is less than the constant period, a warning signal, such as a buzzer, is generated. In another arrangement, means are provided to activate a light within the field of view of the driver.

In the preferred form, the sensor is a soft iron core wrapped with a wire coil. This induction device generates a pulse when the appropriate magnetic fields from the first and second marking elements are detected. By way of example, a horseshoe shaped coil inductor may be attached onto the rear bumper of the vehicle.

The logic circuit is comprised of logic gates configured to compare the length of the constant period pulse to the time period between the first and second pulses initiated by the magnets. The logic gates compare various timing signal high and low values to determine whether or not to sound the alarm. If both the first and second pulses initiated by the magnets enter the circuit before the constant time period deactivates, an alarm will sound.

Traffic and transportation engineers continue to advance technology, in order to make the traveling task easier for vehicle drivers. However, the driver of the vehicle must ultimately be able to control the vehicle in all extreme situations. It is an objective of this invention to aid the driver by providing a warning in advance of a hazardous condition so that the driver has sufficient time to prepare for the hazard and respond in a timely and safe way. The invention gives the driver those few extra but critical seconds in which to react to a dangerous situation in an effective manner.

It is an objective that the invention be constructed to permit performance without the use on complicated or costly marking elements, but by using marking elements that require minimal maintenance. The onboard instrumentation may be installed on existing or new vehicles easily, and at a relatively low cost.

BRIEF DESCRIPTION OF DRAWINGS

A preferred embodiment of the invention is described by way of example with reference to the accompanying drawings in which.

DETAILED DESCRIPTION OF PREFERRED EMBODIMENT

Figure 1:
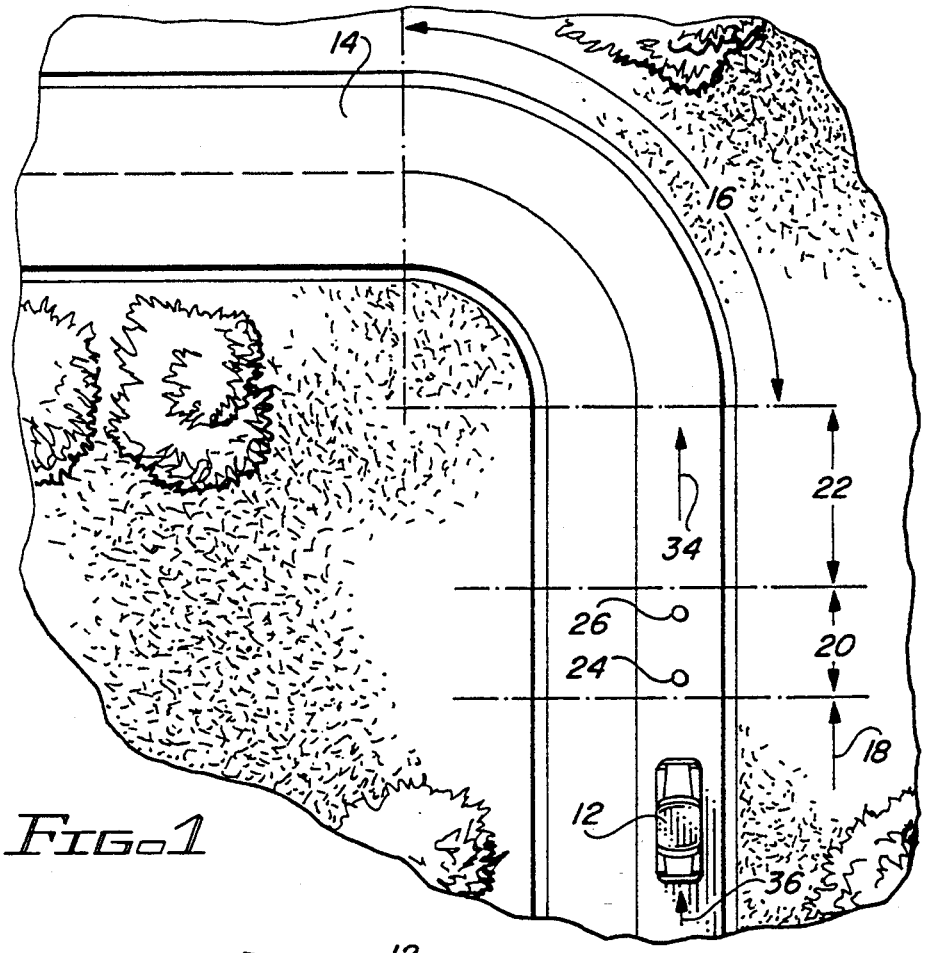
FIG. 1 is a schematic diagram illustrating an overhead view of a motor vehicle on a roadway approaching a signaling area containing marking elements prior to entering a potentially hazardous area of the roadway.

The invention, a motor vehicle warning system 10, provides a driver of a motor vehicle 12 traveling over a roadway 14 sufficient time to react to an approaching roadway hazard 16 such as a sharp curve in the roadway 14. As illustrated in FIG. 1, the vehicle 12 entering the approach area 18 to the hazard 16 is given additional time to react to the hazard 16 by first passing through signaling area 20 and then through a reaction distance area 22 as compared to having to react immediately upon entering the hazard 16. The invention comprises a first marking element 24 and a second marking element 26 that are affixed on the roadway 14 in a designated signaling area 20 appropriate for a specific hazard 16. The hazard 16 used by way of example in FIG. 1 is a sharp curve, but in fact the present invention can be used with all types of hazardous conditions.

Permanent magnets are used as the marking elements 24 and 26. During testing, the magnets were approximately two inches long by one inch wide by one half inch thick and were placed upon the surface of the roadway 14. However, it is anticipated that various configurations of marking elements can be incorporated to produce a magnetic field or other signal to communicate with a compatible sensor for that signal.

Figure 2:
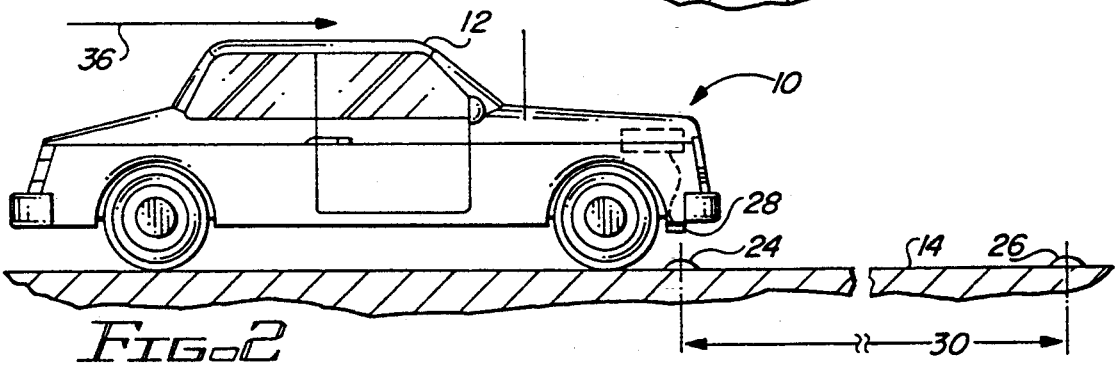
FIG. 2 is an elevation view of the motor vehicle as it approaches the marking elements affixed to the roadway.

FIG. 2 illustrates the placement of the marking elements 24 and 26 in relation to the approaching vehicle 12. The first marking element 24 is so described because it is the first element to be reached by the vehicle 12. The warning system 10 has all its active circuitry onboard the vehicle 12. In the preferred embodiment, a sensor 28 is attached to a bumper of the vehicle 12, although it is anticipated that any section of the vehicle 12 close to the roadway surface can be used for the sensor 28 location.

The first marking element 24 is separated by a distance 30 from the second marking element 26. The distance 30 will be based on an accepted standard time constant period 32 and the predetermined safe speed 34 determined for the particular hazard 16 in question. For example, assume a time constant period of one second (1 sec.) and a safe speed 34 of thirty five miles per hour (35 mph) for executing the hazardous curve 16 illustrated in FIG. 1. A vehicle 12 would travel a distance of approximately fifty one and one third feet (51.33 ft.) if traveling at a speed of 35 mph for one second. The first marking element 24 must then be separated from the second element 26 by this 51.33 feet to establish the safe speed 34 for the hazard 16. In other words, the distance 30 for this example would be 51.33 feet. A safe speed 34 of fifty miles per hour would require the distance 30 between elements to be 73.33 feet. It is anticipated that once a standard has been selected for the constant time period 32, variations in this period can also be selected through either placement of the elements 24, 26 or adjustment in the onboard sensor (described below), or both, in order that a margin of safety can be incorporated to account for additional factors, such as weather conditions, type of vehicle or age of driver as only a few examples.

Figure 3:
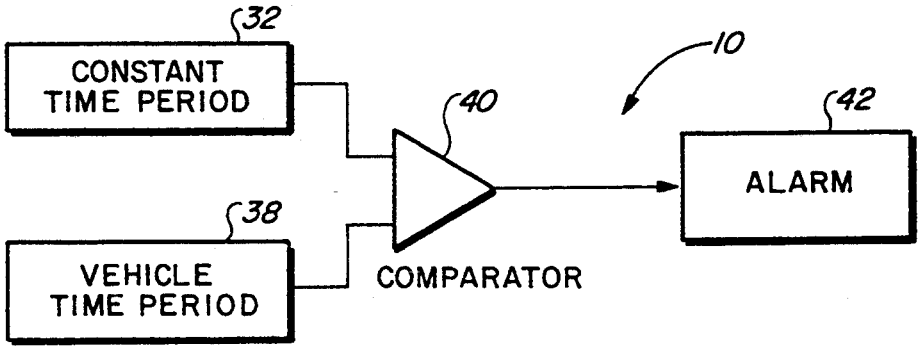
FIG. 3 is a schematic block diagram illustrating the basic comparative circuit used to initiate a warning signal.

The vehicle speed 36 as the vehicle 12 traverses the distance 30 can thus be represented by the period of time 38 taken to traverse the distance 30. The system 10 compares these time periods, the constant time period 32 and the vehicle time period 38 to determine if the vehicle speed 36 exceeds the safe speed 34 needed to safely execute the hazardous curve 16. FIG. 3 illustrates this comparison in a schematic block diagram. If the safe speed 34 is exceeded, the system 10 provides an alarm 42, such as a buzzer or light, to warn the driver that the vehicle is operating at an unsafe speed for the upcoming condition. A combination of a light and buzzer can be used as an alarm 42.

Figure 4:
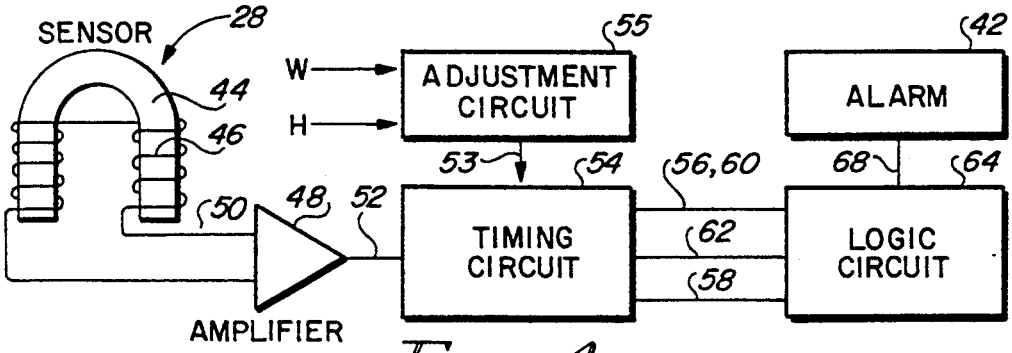
FIG. 4 is a schematic block diagram identifying the sensor, timing and logic scheme used in the preferred embodiment, the various pulse signals are identified.

In the preferred embodiment, an electromagnetic inductor is used to sense the magnetic field provided by the magnets used as the marking elements 24 and 26. In one specific form, a horseshoe-shaped soft iron core 44 is wound with a coil 46 of 34 gauge wire approximately 750 times on each leg of the core 44 to act as the sensor 28 and detect the appropriate magnetic fields from the first and second magnetic elements 24, 26 placed on the roadway 14. This inductive arrangement for the sensor 28 generates a low voltage which is fed into an amplifier 48 as illustrated in FIG. 4. With the sensor 28 placed on the vehicle bumper about six to nine inches above the roadway 14 and a vehicle speed 36 of approximately twenty miles per hour, a sensed pulse 50 of approximately 0.2 volts is generated. An amplifier 48 used in a test system boosts this voltage to an amplified pulse 52 of approximately two to three volts. The amplifier 48 was an operational amplifier using a conventional power supply and resistor/capacitor network typical of such amplifier circuits.

The amplified pulse 52 is the input to a timing circuit 54 which initiates a signal pulse 56 and a constant time pulse 58. The amplified pulse 52 resulting from the sensor 28 passing proximate to the first marking element 24 activates three timers within the timing circuit 54. One timer is set to also receive a second signal pulse 60 resulting when the sensor 28 passes proximate to the second marking element 26. In addition to the sensor pulses 56 and 60 being fed from one output of the timing circuit 54 and the constant time period pulse 58 being fed from a second output of the timing circuit 54, a third inhibit pulse 62 is generated as an aid to the NAND gate logic used in a logic circuitry 64 of the preferred embodiment.

The timing circuit 54 may also be provided with an adjustment input 53 from an adjustment circuit 55, to slightly modify the timing circuit outputs to create a greater margin of safety in order to account for other factors, such as a heavier vehicle or an elderly driver, for example. The adjustment circuit 55 may also be controlled by other inputs from the vehicle; for example, operation of the vehicle's windshield wiper W or headlights H may be used to select a modification input 53 to the timing circuit 54.

Figure 5:
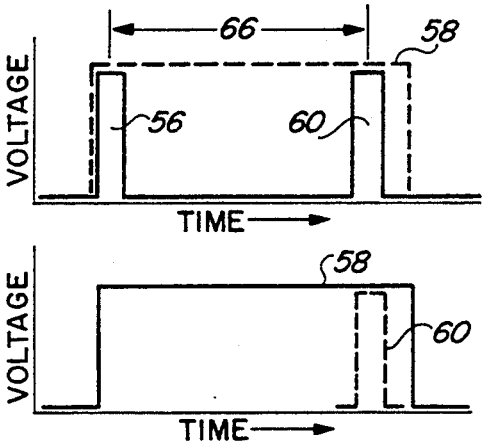
FIG. 5 is a voltage versus time plot illustrating the relationship between a constant period pulse and a shorter vehicle travel interval period resulting in a vehicle speed in excess of a safe speed.
Figure 6:
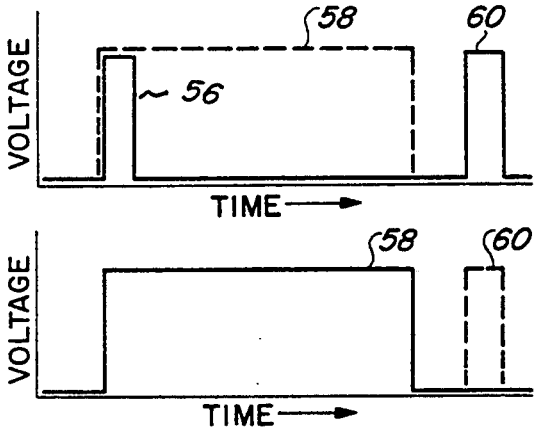
FIG. 6 is a voltage versus time plot illustrating the relationship between a constant period pulse and a longer vehicle travel interval period resulting in a vehicle speed below a safe speed.

The logic circuit 64 detects the time between the first sensed pulse 56 and the second sensed pulse 60 as an indication of vehicle speed 36 based on the established distance 30. A vehicle time period 66 is then determined by this time interval between pulses 56 and 60. If the vehicle time period 66 is less than the established constant time period 58, a warning signal 68 is generated as an indication that the vehicle speed 36 exceeds the safe speed 34 for the approached hazard 16. FIG. 5 and FIG. 6 illustrate the pulse time relationships being compared.

A number of techniques known in the art can be used to implement the circuitry for sensing and processing voltages and generating the vehicle time period 66 and constant time period 58 to be compared in the logic circuitry. It is anticipated that various embodiments will be constructed. Various signal comparison logic circuitry is also anticipated.

Figure 7:
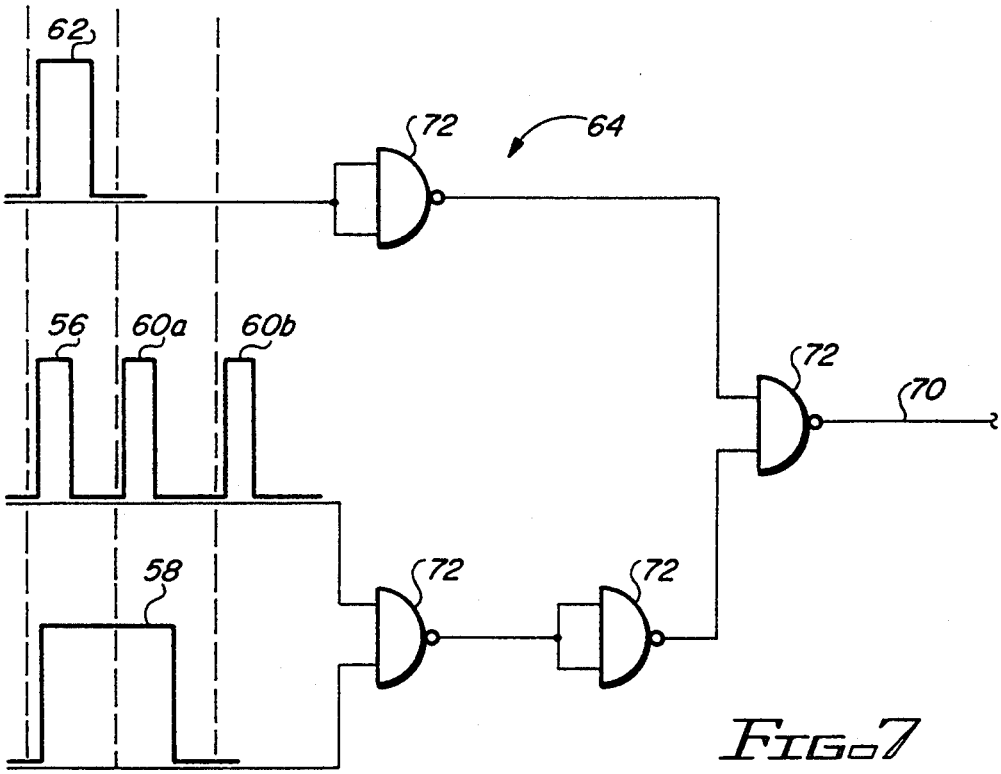
FIG. 7 is a schematic block diagram illustrating the logic scheme used in the preferred embodiment for comparing time intervals and initiating a warning signal when the vehicle time period is less than the constant time period indicative of a safe speed.

In the preferred embodiment, logic NAND gates are used for the comparison method. FIG. 7 illustrates the logic signal processing method. The inhibit 62, first sensed 56 and constant time 58 pulses generated in the timing circuit 54 simultaneously enter the logic circuitry 64 having a comparable voltage signal value. In this condition the output signal 70 from the logic circuitry has a high signal value. If the second sensed pulse **60*a* as illustrated in FIG. 7, is present while the constant pulse 58 is present, the logic output signal 70 will register a low value. This low value is indicative of the vehicle time period 66 being shorter than the constant time period 58 and thus the vehicle speed 36 exceeding the safe speed 34. A warning signal is then generated from this low value logic output signal. If the second sensed pulse 60*b* arrives after or outside the constant time pulse 58, a high output signal 70 will result and no warning signal 68 generated. In the preferred embodiment, an alarm mechanism 42 comprises another 555 Styled timer which activates a buzzer when a low signal is received. It is anticipated that other warning signals can be initiated such as lights or combination of lights and sound mechanisms for use in the vehicle 12 in notifying the driver of impending hazards 16**.

While certain specific embodiments of the present invention have been disclosed as typical, the invention is of course not limited to this particular form, but rather is applicable broadly to all such variations as fall within the scope of the appended claims.

What is claimed is:

1. A motor vehicle warning system for use on a roadway having an established safe speed, the warning system comprising:

a first marking element adapted to be affixed to the roadway at a first location, the first element emitting a first pulse signal for initiating a timing circuit;

a second marking element adapted to be affixed to the roadway at a second location, the second marking element emitting a second pulse signal, the second marking element separated from the first element by a predetermined distance indicative of a safe speed;

a sensor for receiving pulse signals, the sensor adapted for mounting onboard a vehicle, the sensor generating a first sensing signal when receiving the first pulse signal, the first sensing signal indicating proximity to the first marking element and generating a second sensing signal when receiving the second pulse signal, the second sensing signal indicating proximity to the second marking element;

means for sensing an environmental condition;

means for adjusting the safe speed in response to sensing a predetermined environmental condition, the safe speed represented by a constant time period pulse having an elapsed time representative of a vehicle traveling at the safe speed between the elements, the safe speed adjusting means further having means for adjusting the elapsed time; and means for processing the sensed signals based on a vehicle time period for the sensor to pass between the first marking element and the second marking element, the vehicle time period indicative of vehicle speed, the processing means comparing the vehicle speed to the safe speed for providing an alarm signal when the vehicle speed exceeds the safe speed.

2. The motor vehicle warning system as recited in claim 1, wherein the processing means comprises:

a timing circuit coincidentally initiating a start of the constant time period pulse upon receiving the first pulse signal; and a logic circuit comparing the constant time period pulse to a vehicle time period pulse determined to be a time between the first and the second pulse, the logic circuit generating a warning signal when the vehicle time period pulse is less than the constant period pulse thereby indicating that the vehicle speed exceeds the safe speed.

3. A motor vehicle warning system for use on a roadway, the system comprising:

a roadway having a hazard requiring a predetermined safe speed for a vehicle approaching the hazard;

at least one vehicle for movement along the roadway toward the hazard;

a first marking element affixed to the roadway at a first location, the first element emitting a first pulse signal for initiating a timing circuit;

a second marking element affixed to the roadway, the second marking element separated from the first marking element by a predetermined distance along the roadway determined by the predetermined safe speed for a vehicle traveling at the safe speed from the first marking element to the second marking element within an elapsed time indicative of the vehicle safe speed, the second marking element emitting a second pulse signal;

a sensor onboard the vehicle proximate to the roadway, the sensor generating a first sensing signal when receiving the first pulse signal, the first sensing signal indicative of passage of the vehicle proximate the first marking element and a second sensing signal when receiving the second pulse signal, the second sensing signal indicative of passage of the vehicle proximate the second marking element;

a timing circuit coincidentally initiating a start of a constant period pulse representative of the vehicle traveling at the safe speed, the constant period pulse having an elapsed time representative of the time to travel between the elements at the safe speed, the start initiated upon receiving the first pulse signal;

means for sensing an environmental condition;

means for adjusting the constant period pulse representing the safe speed in response to sensing a predetermined environmental condition, thereby adjusting the predetermined safe speed; and a logic circuit comparing the constant period pulse to a vehicle time period pulse representing a time between the first pulse signal and the second pulse signal, the logic circuit generating a warning signal when the time between the first pulse signal and the second pulse signal is less than the elapsed time of the constant period pulse indicative of the vehicle speed exceeding the safe speed.

4. The motor vehicle warning system as recited in claim 3, wherein the marking elements are comprised of permanent magnets, the magnets affixed to the roadway surface a sufficient distance from the hazard so as to provide sufficient warning to a person operating the vehicle approaching the hazard for initiating steps necessary to operate the vehicle in a safe manner.

5. The motor vehicle warning system as recited in claim 4, wherein the sensor onboard the vehicle comprises a magnetic flux sensor, the flux sensor responsive to magnetic flux emitted from the first and second marking magnets affixed to the roadway.

6. A motor vehicle warning system for use on a roadway having an established safe speed, the warning system comprising:

a first marking element and a second marking element, the marking elements each providing an electromagnetic field, the marking elements adapted to be placed on the roadway at a predetermined distance from each other, the distance indicative of a safe speed for a vehicle traveling between the elements;

a magnetic field sensor adapted for mounting onboard a vehicle and proximate to a roadway surface, the sensor capable of detecting the magnetic fields produced by the first and second marking elements as the vehicle passes proximate to the elements, the sensor generating a first pulse signal and a second pulse signal indicative of the sensor proximate the respective elements;

a timing circuit for receiving the first pulse signal from the sensor, the timing circuit generating an output signal for initiating a start of a constant time period pulse signal coincident with a receipt of the first pulse signal, the timing circuit generating a second output signal upon receipt of the second pulse signal as the sensor passes proximate the second marking element;

means for sensing an environmental condition;

means for adjusting the constant time period pulse signal in response to sensing a predetermined environmental condition thereby adjusting the predetermined safe speed for a vehicle traveling between the elements;

a logic circuit for receiving the pulses from the timing circuit, the logic circuit providing an elapsed time period pulse indicative of a time for vehicle travel between the first and second sensors, thereby indicative of a vehicle speed, the logic circuit comparing the constant time period pulse to the elapsed time period pulse, the logic circuit generating a warning signal when the elapsed time period pulse is less than the constant time period pulse; and an alarm connected to the logic circuit activated by the warning signal.

7. The motor vehicle warning system as recited in claim 6, wherein the marking elements are permanent magnets.

8. The motor vehicle warning system as recited in claim 6, wherein the magnetic field sensor comprises:

an electromagnet;

a wire coiled around the poles of the electromagnet; and an operational amplifier having a signal input and an amplified pulse signal output, the input electrically connected to the wire coil.

9. The motor vehicle warning system as recited in claim 6, wherein the alarm is a buzzer, the buzzer providing an audible signal.

10. The motor vehicle warning system as recited in claim 6, wherein the alarm is a light adapted for mounting in a location so as to be viewed by a driver of the motor vehicle.

11. The motor vehicle warning system as recited in claim 6, wherein the logic circuit comprises NAND Gates.

12. A method for providing a warning signal to a driver of a motor vehicle when a speed of the motor vehicle exceeds a predetermined safe speed over a roadway, the method comprising the steps of:

affixing a first marking element to the roadway at a first location, the first element emitting a first pulse signal for initiating a timing circuit;

affixing a second marking element to the roadway at a second location, the second marking element emitting a second pulse signal;

separating the second marking element from the first marking element by a predetermined distance indicating the safe speed for the vehicle traveling over the roadway between the elements;

providing a sensor responsive to the pulse signals;

sensing the first marking element as the vehicle passes proximate the first element;

generating a first sensing signal indicating that the vehicle is proximate the first element;

sensing an environmental condition;

adjusting a predetermined safe speed in response to the environmental condition, sensing of a predetermined safe speed adjusted by changing a constant time period pulse signal having an elapsed time representative of a vehicle traveling at the safe speed between the elements;

initiating the constant time period pulse signal coincident with the first sensing signal;

sensing the second marking element as the vehicle passes proximate the second element;

generating a second sensing signal indicating that the vehicle is proximate the second element;

comparing time elapsed between receipt of the first and second sensing signals to the constant time period pulse signal representative of the vehicle traveling at the safe speed; and generating a warning signal when the elapsed time is less than the constant time period pulse thereby indicating that the vehicle speed exceeds the safe speed.

13. The method as recited in claim 12, wherein the marking elements are permanent magnets emitting a magnetic flux sufficient for sensing.

14. The method as recited in claim 13, wherein the sensing step further comprises the steps of:

providing an electromagnetic induction coil onboard the motor vehicle;

sensing the presence of an electromagnetic field with the induction coil thereby detecting the permanent magnets affixed to the roadway as the motor vehicle passes proximate to the magnets; and generating the sensing signals with the induction coil.

15. The method as recited in claim 17, wherein the comparing and generating steps further comprise the steps of:

providing a timing circuit;

transferring the first sensing signal from the induction coil to the timing circuit;

generating the constant period pulse coincident with the first pulse signal received by the induction coil as the coil passes proximate to the first permanent magnet, the constant time period pulse representative of a vehicle traveling between the elements at the safe speed;

providing a logic circuit;

passing the first and second pulse signals from the timing circuit to the logic circuit;

comparing the constant time period pulse to a time period pulse representing vehicle travel time between the first and second sensing signals, the comparing taking place in the logic circuit;

generating the warning signal from the logic circuit when the time period pulse is shorter than the constant time period pulse; and activating an alarm with the warning signal.

16. The method recited in claim 12, wherein the adjusting step is responsive to the environmental conditions selected from the group consisting of headlights on, headlights off, windshield wiper on, and windshield wiper off.

* * * * *